US005586035A

United States Patent [19]

Martin

[11] Patent Number: 5,586,035

[45] Date of Patent: Dec. 17, 1996

[54] FRANKING MACHINE IN TWO PORTIONS

[75] Inventor: Claude Martin, St. Germain En Laye, France

[73] Assignee: SECAP, Boulogne Billancourt, France

[21] Appl. No.: 228,984

[22] Filed: Apr. 18, 1994

[30] Foreign Application Priority Data

Apr. 21, 1993 [FR] France ..... 93 04694

[51] Int. Cl.[6] ..... G07B 17/00

[52] U.S. Cl. ..... 364/464.02

[58] Field of Search ..... 364/464.02, 464.03, 364/466

[56] References Cited

U.S. PATENT DOCUMENTS

| | | | |
|---|---|---|---|
| 4,266,222 | 5/1981 | Eckert et al. | 364/464.02 X |
| 4,301,507 | 11/1981 | Soderberg et al. | 364/464.03 |
| 4,319,328 | 3/1982 | Eggert | 364/466 |
| 4,471,440 | 9/1984 | Check, Jr. | 364/466 |
| 4,630,210 | 12/1986 | Salazar et al. | 364/167.01 |
| 4,631,681 | 12/1986 | Salazar et al. | 364/464.02 |
| 4,635,205 | 1/1987 | Eckert, Jr. et al. | 364/464.02 |
| 4,636,959 | 1/1987 | Salazar et al. | 364/464.02 |
| 4,646,635 | 3/1987 | Salazar et al. | 364/466 |
| 4,809,186 | 2/1989 | Freeman et al. | 364/464.03 |
| 5,373,450 | 12/1994 | Gallagher et al. | 364/464.02 X |

FOREIGN PATENT DOCUMENTS

| | | |
|---|---|---|
| 0086396 | 8/1983 | European Pat. Off. . |
| WO83/02180 | 6/1983 | WIPO . |

*Primary Examiner*—Edward R. Cosimano
*Attorney, Agent, or Firm*—Kenyon & Kenyon

[57] ABSTRACT

A postage machine includes a first meter portion comprising postage means commanded by a first microprocessor (50), a keyboard (22) and a display (21 ), and a second base portion comprising a second Microprocessor (53). The first and second microprocessors, in a normal mode, mode carry into practice a communications protocol adapted to have transmitted to the base messages representative of at least some of the commands acquired on the keyboard (22) and to have retransmitted from the base to the meter the commands executable by said meter, in such a way that, from the keyboard (22) of the meter, at least certain functions cannot be commanded unless the commands relative to such functions pass through pass through the base (12).

23 Claims, 4 Drawing Sheets

FRANKING MACHINE IN TWO PORTIONS

TECHNICAL FIELD

This invention relates to a franking machine which comprises in particular a first portion called the "meter" and a second portion called the "base", a keyboard associated with the first portion, and communication means connecting these portions.

BACKGROUND OF THE INVENTION

Such an arrangement, which is known in the prior art, helps to distribute the functions performed by the franking machine between the meter and the base. Thus the meter performs strictly postal functions, including the sensitive accounting and printing functions, which must be protected against any attempt at fraud or accidental deterioration of the information, while the base performs most of the non-sensitive functions, that is to say functions not requiring the same level of security.

The base is also susceptible to contain a set of electronic cards permitting the management of peripherals such as an electronic pre-settable franking label dispenser, a printer, a postal balance etc.

The communication means enable the base and the meter to effect a two-way exchange of any information required for the proper operation of these components.

The meter comprises a microprocessor programmed in particular to perform the highly protected postal functions, including the keeping of the accounting registers, and in particular the register concerning the status of the user's postal account, at any time, updated after each postage operation. A program is also provided permitting the modification of the content of these registers, and particularly of the account status register, on the occasion of the recharging of the machine with postal funds.

To ensure the dialogue between the operator and the franking machine, the meter comprises acquisition means, such as a keyboard, and display means.

In general the software of the meter is highly protected, to prevent any attempt at fraud.

Furthermore, it is known that the postage meter must be subject to the approval of the postal administration. When this approval is obtained, it is not easy to modify or to add new functions to an approved postage meter in order to make it evolve.

In these conditions, moreover, the software of the meter is fixed. And if one wishes to upgrade the features of the machine, it is consequently advisable not to have to modify this software.

From another standpoint, it is always very difficult to provide means making it possible to have the franking machine comply with the different foreign postal regulations without modifying the software of the meter. In fact, for essential manufacturing reasons, it is desirable that the software of the meter of the franking machine intended e.g., for the French postal administration and of the franking machine intended for other postal administrations be the same.

SUMMARY OF THE INVENTION

In accordance with the above, it is an object of this invention to make open-ended, that is to say subject to improvement, especially by the addition of new functions, a franking machine of which the software of the meter cannot be modified.

Another object is to be able to reconfigure the keyboard of the meter as required, and to use the latter both to command the postage functions as well as the non-postage functions specific to the base.

Another object is also to be able to select specific functions which may be available to a user in a certain country, but not in others.

Another object is to be able to translate into several languages the information appearing on the display screen, without having to modify the meter to do so.

These objects are achieved by a franking machine whose structure has been summarily described above, wherein the first and second microprocessors carry into practice, in a normal operating mode, a communications protocol adapted for the transmission to the base of representative messages of at least some of the commands acquired on the keyboard, and for the retransmission from the base to the meter of the commands executable by the meter, so that from the meter keyboard, it is not possible to command at least certain functions, unless the commands relative to such functions pass through the base.

In accordance with the present invention, the machine may also be one wherein said first microprocessor is arranged so that, in a normal operating mode, it identifies the key or keys pressed, and causes one or more representative messages of the identification to be transmitted to the base by said communication means, and further wherein said second microprocessor is arranged to interpret the messages received, and to have one or more representative messages of orders executable by the first microprocessor transmitted via said communication means, in such a way that, from the keyboard to the meter, it is not possible, in said normal operating mode, to command any function at least related with postage, unless the command of these functions passes through the base.

By means of these arrangements, the commands pressed by the user on the keyboard are, before their execution by the meter microprocessor, transmitted to the base microprocessor, which takes charge of transmitting an execution message to the meter microprocessor. In this way, it is possible to prevent the execution by the meter of certain orders pressed on the meter keyboard, by preventing the transmission of the corresponding messages by the base, but it may be observed that, to do so, the software contained in the program memory of the first microprocessor has not been modified.

In addition, it is easy to reconfigure the keyboard (for example, to switch from an AZERTY keyboard to a QWERTY keyboard) by modifying only the program contained in the base.

BRIEF DESCRIPTION OF THE DRAWINGS

The above and other objects and advantages of the invention will be apparent from the following description taken in conjunction with the accompanying drawings wherein.

DETAILED DESCRIPTION

Figure 1:
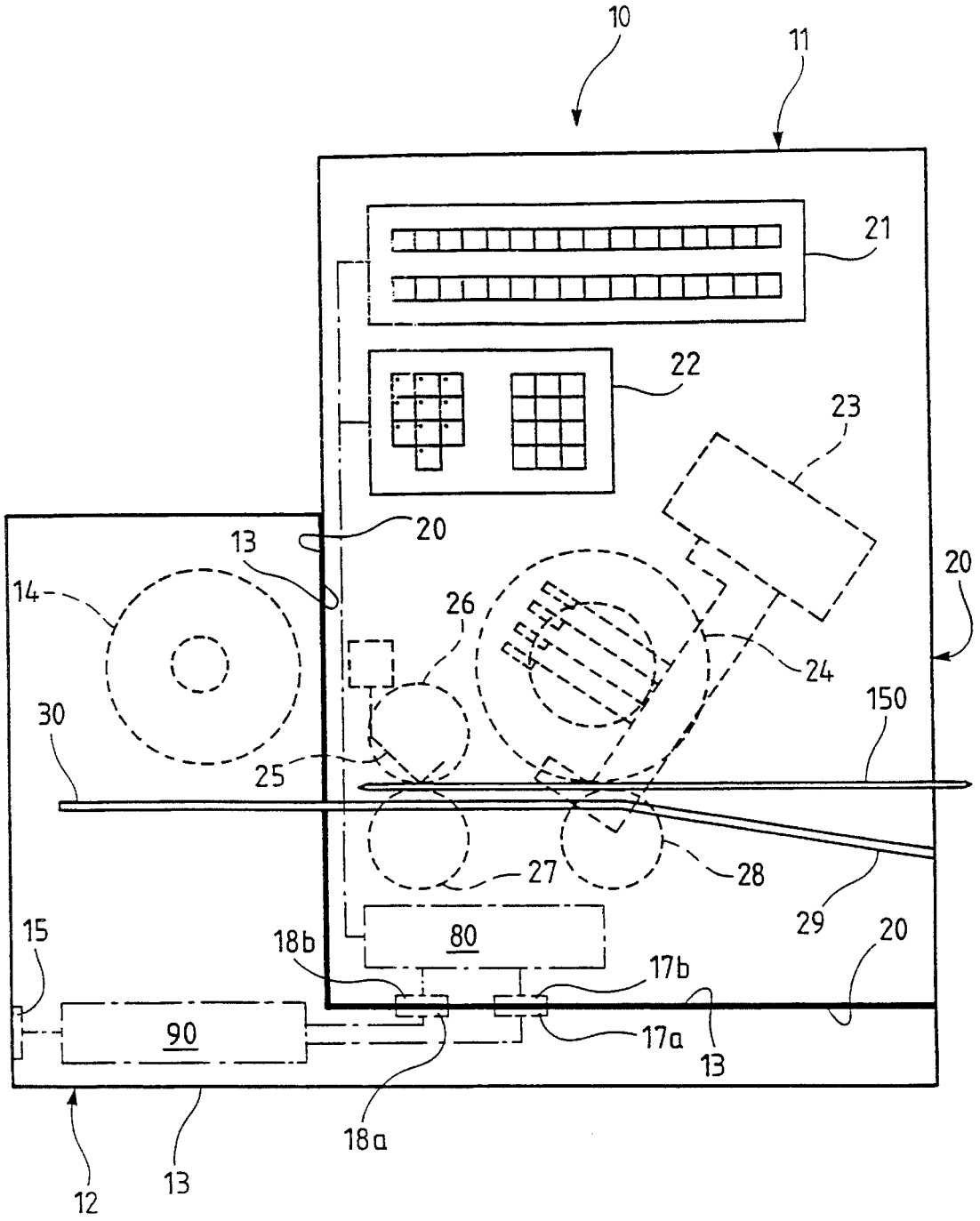
FIG. 1 is a schematic view showing the arrangement of the main mechanical means of a franking machine carrying the invention into practice.
Figure 2:
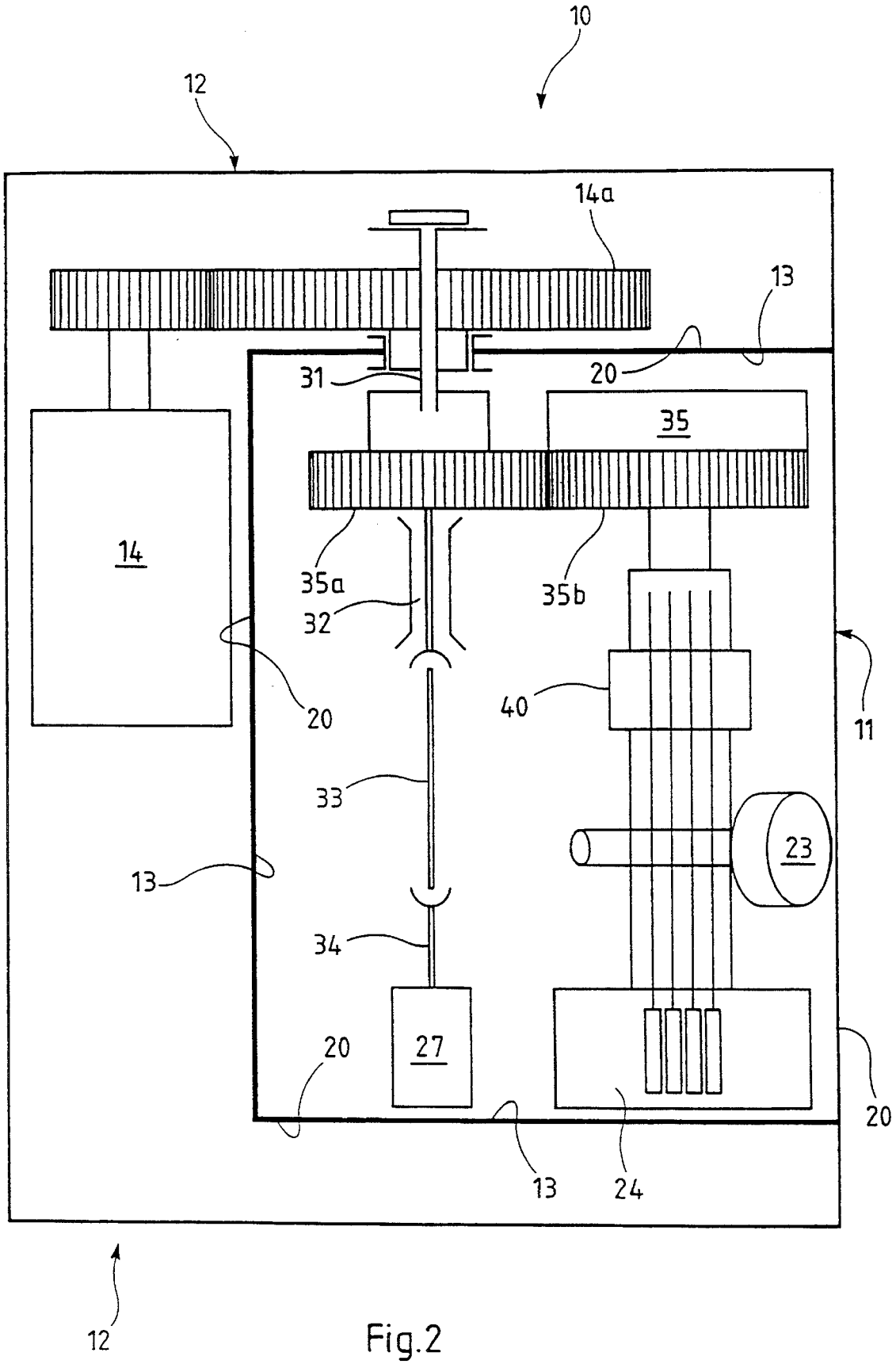
FIG. 2 is a schematic simplified plan view of the meter shown in FIG. 1.

By definition, the present invention is carried into practice in a franking machine with a conventional structure comprising two portions, a first meter portion, and a second base portion. In FIG. 1 and 2, the main components of such a franking machine 10 have been shown for guidance, it being understood that, on the filing date of the present application, the person skilled in the art is thoroughly familiar with a franking machine in two portions. In these figures, the meter is shown by reference 11, while the base is shown by reference 12.

The base 12 comprises a housing/frame shown by reference 13 supporting, in a also know, a motor 14, a connector 15 for connection to peripherals (not shown), a connector 182 for electrical connection with the meter 11, and a connector 17*a* for a logic link with said meter.

The postage meter 11 comprises a housing/frame shown by reference 20. Conventionally, the meter 11 comprises, arranged in this housing, a display 21 and a keyboard 22 which comprises, in this embodiment, on the one hand, numeric keys, and, on the other, function keys. In an alternative embodiment, the keyboard may also comprise alphabetical keys configured, for example, in the AZERTY form. Conventionally the meter 11 comprises a postage mechanism which itself comprises a printing drum shown by reference 24, a mechanism 23 for setting the postage value by means of a stepper motor (not shown in this figure, but corresponding to the one described in European Patent No.0.181.804), a device 26,27,28 to drive the letters or franking labels requiring postage to be issued, essentially comprising the rollers shown, a guide and ejection table for the letters requiring postage, shown by reference 29 (presenting a corresponding portion 30 in the base, in order to form a continuous table) and a sensing device 25 to detect the passage of the envelopes. One of these envelopes is shown in FIG. 1 by reference 150.

The base also comprises a unit 14*a* for transmitting the torque of the motor 14 to the meter 11. The transmission gear 14*a* (FIG. 2) is connected to a coupling device 31 which is itself connected, by the intermediary of various shafts shown by references 32,33,34, to the set of rollers 26,27,28 and to the postage drum 24 by a clutch shown by reference 35. The clutch 35 receives the drive power by a pair of gear means 35*a* and 35*b*. The clutch 35 is actuated by an engagement device not shown.

In a known manner, the meter and the base comprise electronic cards which themselves comprise microprocessors performing the various functions of the franking machine.

In the meter, the electronic cards are shown in FIG. 1 by reference 80. They are connected to the connector 18*b*, for electrical connection, and to a connector 17*b* for a logic link with the base. The circuitry 80 of the meter is connected to the output of the sensing device, and to a unit, shown by reference 40, for checking the postage value (which is described in the French Patent FR-2.645.267 to assigned the assignee of this application. As explained in this document, the unit 40 monitors the mechanism 23 for setting the postage value. The circuitry 80 of the meter is also connected to the display 21 and to the keyboard 22.

The circuitry of the base shown by reference 90 performs the various functions specific to said base, including the management of certain peripherals (for example, postal scales, label dispenser etc).

This set of aforementioned arrangements has been perfectly conventional for the past fifteen years in the field of franking machines, and need not be described in detail here. The description of such an arrangement can in fact be found inter alia in various patents filed previously, including the British Patent GB-1.508.6.23, of which the descriptions are incorporated here.

Figure 3:
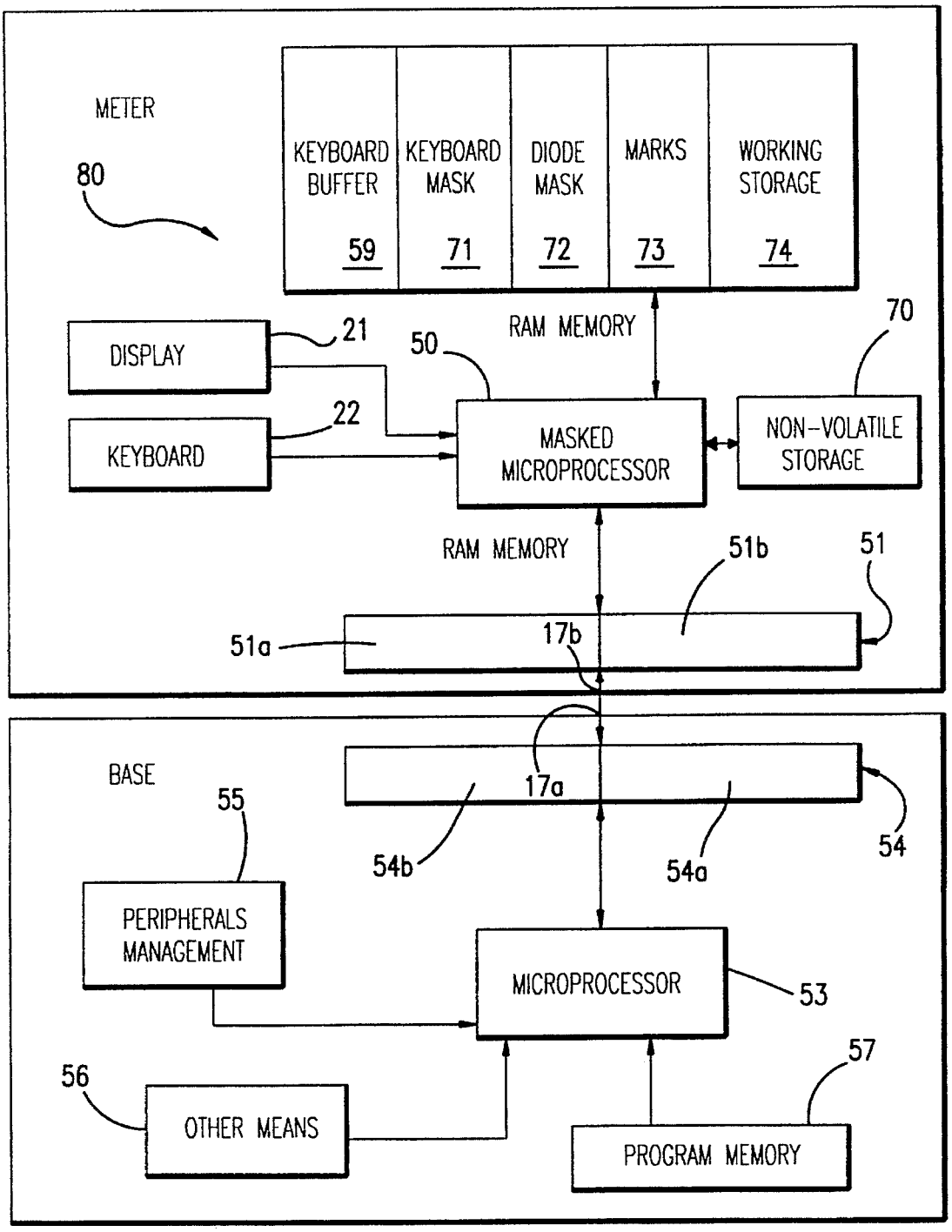
FIG. 3 shows the material organization of a portion of the franking machine shown in FIGS. 1 and 2.
Figure 4:
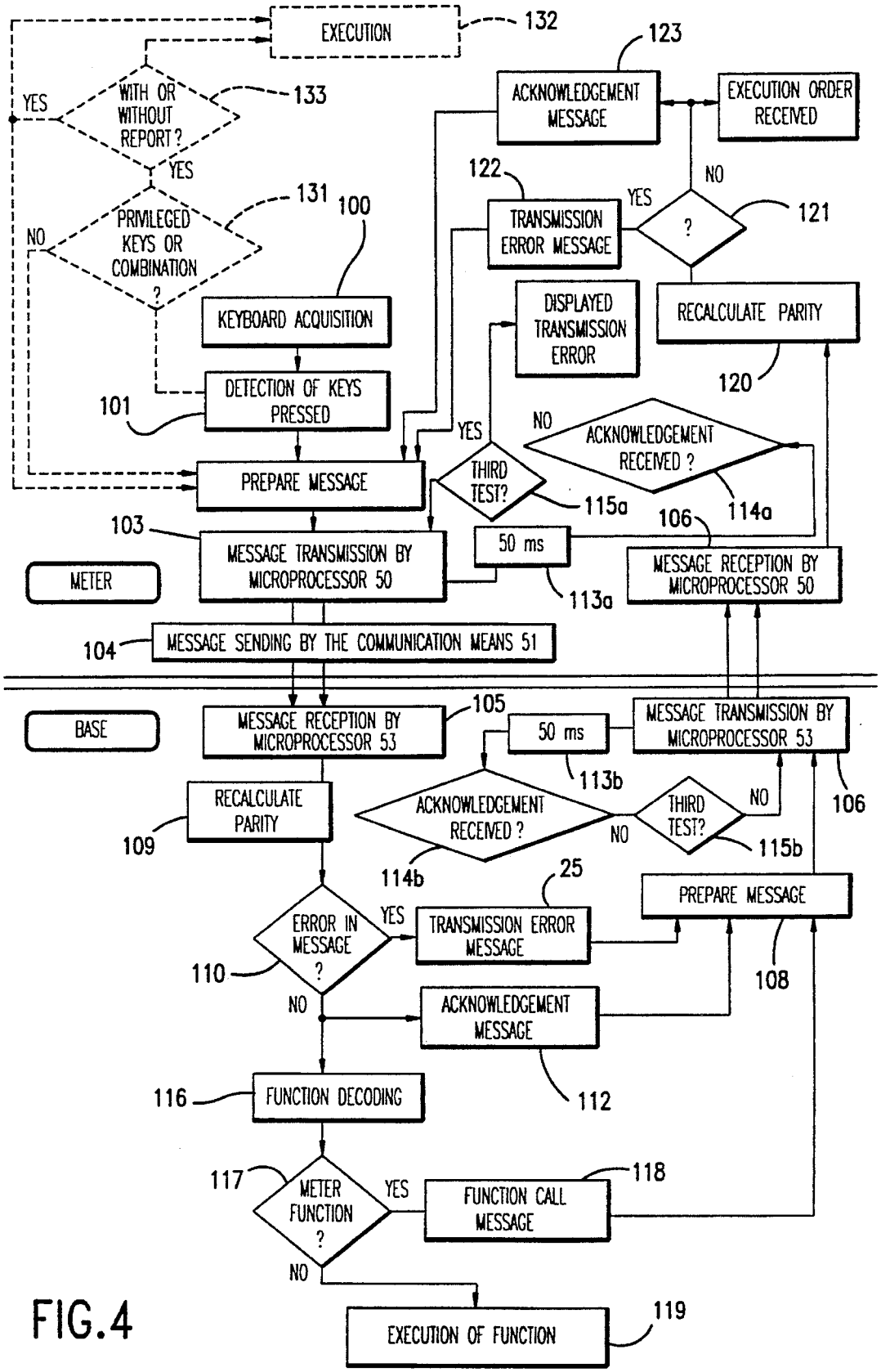
FIG. 4 is a block diagram showing the interaction of the two portions of the machine, in accordance with the invention.

We shall now describe, with the aid of FIGS. 3 and 4, the improvement made by the present invention to the franking machine like the one described above.

FIG. 3 is a schematic representation of the franking machine described above with the aid of FIGS. 1 and 2. This figure shows certain means necessary for the understanding of the present invention.

The circuitry 80 of the meter essentially comprises a masked microprocessor 50, that is to say equipped with its program etched on the same electronic chip, connected in particular:

to the display 21, to the keyboard 22, to communication means 51: these communication means comprise transmitting means 51*a* and receiving means 51*b*, managed by the microprocessor 50 and connected to the connector 17*b*, to a non-volatile storage 70 to store the postal data, to a RAM memory comprising in particular:

*a keyboard buffer zone 59, storing the keys of the keyboard that have been used,

*a keyboard mask zone 71, storing the permitted keys of this keyboard,

*a illumination mask zone 72 for lighting the light-emitting diodes associated with the keyboard,

*a zone 73 containing marks showing the status of the different units or functions of the meter,

*a zone 74 that serves as a working storage for the various functions performed by the microprocessor 50.

The keyboard buffer 59 consists of a two-byte register ($X_1$,X2) (see Table II). Between two clearings, this register copies the keys that have been pressed, in order to reproduce a map of all the keys that have been pressed at least once.

The keyboard mask 71 ($Y_1$,$Y_2$) has a two-type register, whose bits are assigned in the same way as those of the buffer. These bits, depending on their position, permit or inhibit each key of the keyboard.

The illumination mask 72 of the light-emitting diodes associated with the keyboard (see Table I) is a register which comprises two bits per diode, or two bytes ($Z_1$,$Z_2$) for eight diodes (limited to six diodes in this embodiment). When the two bits are in the same status, the diode is lit (logic status 1) or off (logic status 0), and when they are in a different status, the diode flashes.

Similarly, the circuitry 90 of the base 12 comprises a microprocessor 53 and its program memory 57 connected in particular:

to communication means 54: these communication means, which are connected to connector 17*a*, comprise transmitting means 54*a* and receiving means 54*b* managed by the microprocessor 53, to means, of a known structure, for managing the peripherals associated with the base: these managing means are shown by reference 55, and to other means intended to perform the conventional functions generally attributed to the base: these other means are shown by reference 56.

It may again be observed that the keyboard and base are connected by communication means 51,54 which are themselves connected to each other by a serial link represented here by the logic link connectors 17*a* and 17*b*.

The present invention carries into practice a particular cooperation of the microprocessor 50,53 and of the communication means 51,54 in order to permit the use of the keyboard 22 and of the display 21 to command or monitor functions performed both by the meter and by the base, while assigning to the base the monitoring of the operations, in so far as postal security is not affected. This organization is also intended to permit the reconfiguration of the keyboard 22 and of the display formats of the display 21.

The microprocessors 50 and 53 are programmed to perform the various postage and management functions.

The program memory of the microprocessor 50, which is masked, as stated above, contains the programs which manage and check the postage operations and functions (setting of the postage value, management of the ascending register and of the descending register, as well as the error codes associated with these functions). They also manage and check the keyboard 22 and the display 21 (scan of the keys of the keyboard to identify a pressed key, sending to the display of the characters to be displayed and the control codes). These programs also manage the communication means 51 and, in particular, the recognition of the codes received to call such or such a function.

The program memory of the microprocessor 53 of the base is not masked. The programs contained therein generate all the non-postage functions, such as management of peripherals (for example, label dispenser, external printer, postal scales, accounting meter). The different messages to be transmitted are also generated by these programs. These messages allow the control of all the functions of the meter, including the display and the keyboard.

We shall now describe the features specific to the invention carried into practice in the embodiment of the franking machine selected, and shown in the drawings.

As described above, one of the aspects of the invention resides in a communications protocol between the meter 11 and the base 12 as the result of the pressing of certain orders on the keyboard 22, previous to their execution by the meter, to permit the base 12 to confirm the execution of the desired order. The logic specific to the dialogue is described with reference to FIG. 4.

Description of the protocol

In general, communication between the meter 11 and the base 12 is effected by the sending of messages (also called commands ) from the meter to the base and vice versa. In this embodiment, the messages or commands are encoded on bytes, defining function or data parameters, and also comprise agreed words indicating the start and end of the message.

In the description below, the following conventions are used:

the figures 0 to 9 and the letters A to F in underlined italic capitals represent hexadecimal figures, words in parentheses and in underlined italic letters represent bytes: these can be data bytes which are called as follows: (function code), (data), (control code), (parameters), (ASCII text): they can also be a parity check byte: (parity), the letters X, Y and Z in underlined italics, possibly subscripted, represent data or address bytes in the random access memories, the thirteen different messages are denoted DC0, DC1, . . . , DCC.

Except for the error or acknowledgement messages, the general format of the messages or commands is:

FX, (data), (parity), FF where:

Fx is a starting byte of a value between F0 and FC, corresponding to each of the messages or commands DC0 to DCC, data one or more bytes which convey information such as control or function codes, and possibly the parameter or parameters necessary for the execution of the function selected, parity a parity byte which is calculated with an exclusive OR byte by byte on the whole message, FF a byte that marks the end of the message.

After sending the message via the base or the meter, the receiver (the meter or the base) awaits the end of message byte FF. It recalculates its parity. Two alternatives are then available:

the recalculation of the parity yields a correct result: the receiver sends an acknowledgement composed of the two bytes FD, FF, the recalculation of the parity yields a wrong result: the receiver returns an error message composed of the two bytes FE, FF, If, after 50 ms, the receiver has not sent the acknowledgement FD, FF or the error message FE, FF, the transmitter again sends the same message (see below description FIG. 4). After three fruitless attempts, an error code is displayed on the initiative of the meter 11 on the display 21, if the meter has not received an acknowledgement or an error message.

In the event that a meter to base transmission is effected at the same time as a base to meter transmission (collision), the procedure is as follows:

on the base side: the transmission to the meter is interrupted, on the meter side: if FF has already been sent, the receive buffer is erased: transmission priority is thus assigned to the meter.

List of messages (1)Message DC0

This message is only transmitted from the base to the meter. Its format is:

F0 (control code), (parity), FF

The control code, on one byte, can have three values:

C0: display of the word ERR+error code read in the memory of the meter on the display.

C1: validation of the postage value, and setting in of the printer.

C2: permission to initiate printing.

(2)Message DC1

(a)When this message is transmitted from the base to the meter, it transmits function codes to the display of the meter, for example tabulation.

Its format is accordingly:

F1, (function code), (parameters), (parity), FF (b)If this message is transmitted from the meter to the base, it transmits the result of the reading of a register which has been designated by a command DC5 (see below). Its format is accordingly:

F1, ($X_1$, . . . , $X_n$), (parity), FF, where:

($X_1$, . . . , $X_n$): data recorded in the register designated by the command DC5.

(3)Message DC2

(a)When it is transmitted by the base, it transmits to the display of the meter the ASCII encoded characters of the message to be displayed. Its format is:

F2, (ASCII text), (parity), FF (b)When it is transmitted by the meter, it constitutes the mechanical and electronic initialization command. Its format is accordingly:

F2, (parity), FF (4)Message DC3

(a)When it is transmitted by the base, it sends the illumination mask of the diodes associated with the keys of the keyboard (two bytes $Z_1$, $Z_2$, see Table I). Its format is:

F3, ($Z_1$,$Z_2$), (parity), FF (b)When it is transmitted by the meter, it constitutes the acknowledgement of postage message (postage effected). Its format is:

F3, (parity), FF (5)Message DC4

(a)When it is transmitted by the base, it transmits the keyboard mask to the meter (two bytes $Y_1$,$Y_2$, see Annexe II). Its format is:

F4, ($Y_1$,$Y_2$), (parity), FF (b)When it is transmitted by the meter, it transmits the content of the keyboard buffer to the base (two bytes $X_1$,$X_2$, see Table II). Its format is:

F4, ($X_1$,$X_2$), (parity), FF (6)Message DC (a)When it is transmitted by the base, it constitutes the read command of the E bytes from the address of the RAM random access memory of the meter microprocessor (53). Its format is:

FS, (X,Y), (parity), FF (b)When it is transmitted by the meter, it reports the release of the last key pressed (if several keys have been pressed simultaneously, the last one released triggers the transmission of the message). Its format is:

F5, (parity), FF (7)Message DC6

This message is exclusively transmitted by the base. It constitutes a write command of X bytes from the address Y of the RAM random access memory associated with the meter microprocessor (53). Note that certain addresses are nevertheless protected against writing, for example the postal registers. Its format is:

F6, (X,Y), (data to be recorded), (parity), FF (8)Message DC7

This message is exclusively transmitted by the base. It constitutes a command to re-write the keyboard buffer or X bytes from the address Y. Its format is:

F7, (X,Y), (parity), FF (9)Message DC8

This message is exclusively transmitted by the base. It constitutes a command to display the total credit contained in the non-volatile memory 70 of the meter in which the value of the ascending register is recorded. Its format is:

F8, (parity), FF (10)Message DC9

This message is exclusively transmitted by the base. It constitutes a command to display the current postage value contained in the RAM memory associated with the meter microprocessor 50. Its format is:

F9, (parity), FF (11)Message DCA

This message is exclusively transmitted by the base. It constitutes a command which validates (in this case sets to one), in accordance with the mask consisting of the byte Y of the mark bits contained, at the address specified by the byte X, in the RAM random access memory associated with the meter. Its format is:

FA, (X,Y), (parity), FF (12)Message DCB

This message is exclusively transmitted by the base. It constitutes a command which invalidates (in this case sets to zero), in accordance with the mask consisting of byte X of the mark bits contained, at the address specified by byte X, in the RAM random access memory associated with the meter. Its format is:

FB, (X,Y), (parity), FF (13)Message DC0

This message is transmitted by the base. It constitutes the command to clear the display windows. Its format is:

FC, (parity), FF

Communications protocol from acquisition on the meter keyboard

FIG. 4 shows the sequence of operations from the acquisition (100) of the keyboard keys, and illustrates the communications protocol between the base and the meter.

This protocol is implemented in programs recorded in the microprocessors 50 and 53. These programs comprise in particular receiving, preparation and message transmission routines, as well as subroutines to manage the serial communication means 51 and 54. These routines and subroutines are within the scope of the person skilled in the art, who can also implement the protocol described here on the basis of the following information. The program is not appended to the present Application for reasons of security of the postage meters that will be manufactured and marketed after the filing of the present Application.

The microprocessor 50, located in the meter, manages keyboard 22, that is to say it detects all the keys as they are pressed (101). It prepares messages reporting the pressing of these keys (102) (see description of operation). These messages are transmitted (103) by microprocessor 50 and then sent (104) by transmitting means 51*a* which comprise the communication means 51 in the direction of the base, passing through the serial link 17*a*,17*b* (step 104).

The message sent by the meter is received by the receiving means 54*b* of the base. The message received is first checked, in order to determine whether it is complete, and to ensure that it does not contain a transmission error. To do this, the parity byte is recalculated (step 109) from the message received, and compared with the parity byte received in the message (test 110). If the recalculated parity and the transmitted parity are different, a transmission error message (FE,FF) is prepared (111,108) and then sent (106, 107) by the transmitting means 54*a* to the meter. If the parities are identical, a no-error acknowledgement message (FD,FF) is prepared (112,108) and then sent (106,107) in the same conditions.

At the same time that the message has been sent by the meter, a time lag of 50 ms (113*a*) is started in the meter. When this time lag has elapsed, a test (114*a*) is performed in the meter, to determine whether a no-error acknowledgement message (FD,FF) has actually been received. If not (115*a*), the initial message is again transmitted to the base. Three attempts are thus made. If, after these three attempts, the no-error acknowledgement message has still not been received, an error code is displayed on the display 21 of the meter, indicating that the system is inoperative, and that the Maintenance Department should be notified.

When the message has been received and has given rise to a no-error acknowledgement, it is decoded (116) and its content is examined (test 117) to determine whether this message is sent to the base, or whether it is a message concerning the meter. The conditions of this examination are fully determined by the program of the base microprocessor 53. This means that the correspondence, that has been described above, between the messages received from the meter and the messages that the base sends back to the meter and their significance is merely indicative. This correspondence can be modified by the simple modification of the program of the base microprocessor 53.

If the message received concerns a function of the meter, one (or more) messages relative to the function is (are) prepared (118,108) and then sent (106,107) to the meter for the execution of the function. The message or messages are received by the receiving means 51*b*. Similar checking operations to those described above are then executed. The parity of the message is first recalculated (120). A test (121) is then carried out to determine whether the recalculated parity and the transmitted parity are different or not. If they are different, a transmission error message (FE,FF) is prepared (122,102) and then transmitted (103). On the assumption of no error, an acknowledgement message (FD,FF) is prepared (123,102) and then transmitted. A time lag of 50 ms is started (113*b*) in the base microprocessor each time a message is sent, a test (114*b*) is carried out to determine whether a no-error acknowledgement message (FD,FF) has actually been received. If not (115*b*), the message is again transmitted to the meter. Three attempts are thus made.

After these three attempts, if they are fruitless, the transmission of a message from the base becomes impossible. Because of this, since the next message from the meter is no longer followed by an acknowledgement, an error message is displayed in accordance with the procedure described above.

Finally, if the message transmitted by the meter is sent to one of the functions managed by the base, for example dispense labels, or print a line of a report or a statement, the microprocessor 53 takes charge of this request (step 119).

In short, the protocol described carries into practice the two-way communication system between the meter and the base which guarantees very high security, and permanent monitoring of its satisfactory operation.

It should be recalled here that the interpretation of the messages transmitted from the keyboard of the meter and the return, via the base, of the message executable by the meter are effected by the software recorded in the base microprocessor 53. This software can be modified. However, the software of the meter microprocessor 50 is fixed once and for all, and is only capable of understanding certain messages. The present invention thus offers both some degree of flexibility, because the interpretation of the messages sent by the meter and the sending by the base of orders that are executable by the meter can be modified. However, the present invention simultaneously offers a high degree of security, because the structure of the messages understandable by the meter is fixed once and for all, whereas the sensitive registers (for example the postal registers) cannot be modified by the messages transmitted from the base. Furthermore, it can also be observed that the significance of the keys pressed on the meter keyboard is determined by the base, so that, by the simple modification of the software of the microprocessor 53, it is possible to reconfigure the keyboard.

Operation of the franking machine in keyboard mode

The franking machine described here is capable of operating:

in keyboard mode, that is to say in a mode in which the commands and the data (especially postage) are acquired on the keyboard 22, in postal scales in which the keyboard is partly inhibited and in which the commands and postage data are transmitted to the base by a peripheral which comprises a postage scales and a postage calculator.

The operation of the franking machine in keyboard mode will now be described.

It may also be noted that, in certain alternative embodiments, the keyboard mode itself comprises several operating modes:

a normal mode in which the keyboard is used to acquire commands and postage data, recharging or modification modes in which the keyboard is used by authorized users to recharge the machine with postal funds and/or modify certain features.

In the first preferred embodiment described first below, the franking machine is only capable of operating in normal mode.

Whenever a numeric key of the keyboard 22 is pressed, the keyboard buffer 59 is updated, and the code of the corresponding figure is placed in the working zone of the RAM of the meter microprocessor. When the key is released, a message DC5 is sent to the base microprocessor. When a function key is pressed, the keyboard buffer is updated and a message DC4 is sent to the base microprocessor 53. This message transmits the content of the keyboard buffer 59. This keyboard buffer is then cleared before the base microprocessor accepts any new key pressings. Finally, when the key is released, a message DC5 is sent to the base microprocessor.

The content of the keyboard buffer is analyzed by the base microprocessor 53, in order to determine its subsequent behavior. If the base needs further information, it will send a message DC5 to which the meter will make an answer by DC1.

The base microprocessor will then first proceed with the commands necessary to execute the assignment defined by the function key contained in the keyboard buffer (for example actuate the label dispenser, display a message on the screen by means of messages DC1 and DC2, modify the keyboard buffer to inhibit certain keys and activate others, send an order to the meter to validate the postage value by a message DC1, or any other action determined by the function code received and the program of the base microprocessor). It will then secondly send a message DC6 to clear the keyboard buffer.

It should be noted here that it is in the program of the base microprocessor that the instructions executed on the recognition of a mask received from the keyboard are found. This means that it is the base microprocessor that decides on the significance of a key of the meter keyboard, and which may give several effects to the same key at different times in the running of the program. The process described thus makes it possible, by modifying only the signs marking the keys, and without modifying the meter in any way whatsoever, but by modifying only the program of the base, to change the assignment and/or the role of the keys of said keyboard. This makes it possible to create new combinations of functions in the meter, obtained by combinations of elementary functions available in the meter and which can be called by the base.

It may also be observed that, in the normal operating mode of the franking machine described here, no function command related to postage, acquired on keyboard 22, can be executed unless said command has passed through the base, which is favorable for the potential reconfiguration of the keyboard and the addition of new functions by the mere modification of the base, and also confers good security on the franking machine because the structure of the commands understandable by the meter microprocessor is fixed once and for all in the masked software of the meter microprocessor 50.

As an alternative, the operation described above can be substantially modified as follows: whenever a numeric key is released, on the receipt of the resulting message DC5, the base microprocessor can intervene to read the code of the figure in the working storage, and use it as it wishes: for example, memorize this code to pick up the rest of the figures pressed on the keyboard and interpret their combination, or replace the code in question in the working storage of the meter by another code, which makes it possible to redesign the keys of the numeric keyboard.

In a second preferred embodiment, all the data pressed on the keyboard are not relayed by the base, in so far as they do not concern the security of the postage function: for example, the transfer of the value of the figures typed on the keyboard in the working storage, and the transfer of the printing offset values are also transferred directly from the working register to the print shift register, when the IMPRINT key is pressed. But, in both cases, thanks to the messages sent upon the release of the keys, and to the messages transmitting the content of the keyboard buffer, the base microprocessor is informed and can still reconstitute the command actions executed. It is then possible for the base to intervene by sending messages designed to interdict or to modify these commands, and report accordingly on the display of the meter.

In the second preferred embodiment, the franking machine is capable of operating in recharging mode and, for this purpose, additional commands exist which are directly executed in the meter, without the base microprocessor being informed or being able to intervene: these are the commands concerning the reloading of the credit register of the franking machine by the personnel authorized to do so, or by using procedures designed to restrict access: for example, access to such a reloading may imply the use of a secret code: the secret code, pressed on the meter keyboard, is recognized by the microprocessor 50 and does not cause any message transmission. Similarly, the data then typed on the keyboard to reload the descending register, once the authorization has been received or after the use of an access key, also does not initiate a report message to the base.

In this second preferred embodiment, the protocol described with reference to FIG. 4 is significantly modified. The modifications are shown by dashed lines. After step (101) of the detection of the keys pressed, a test (131) is carried out in order to determine whether the key or combination of keys pressed are privileged (that is to say that they correspond to the orders directly executable by the meter, without passing through the base for example: recognition of the access code to recharging mode). In the affirmative, the microprocessor 50 commands the execution (132) of these orders (for example, passage to recharging mode). In the negative, step (102) of message preparation can be executed as described above. A test (133) can also be provided to prevent the report to the base of certain orders executable by the meter (in recharging mode). In other respects the protocol is unchanged.

Operation of the franking machine in postal scales mode

In the two preferred embodiments, the franking machine can operate without using the keyboard: for example, this is operating mode of the machine when coupled with a peripheral consisting of a postal scales equipped with a postage calculator. Such a peripheral is well-known in the prior art. To set the franking machine in postal scales mode, the operator presses a key designated postal scales on the keyboard, which has the effect of sending to the base a message DC4 transmitting the keyboard mask, which allows the base microprocessor 53 to identify the key designated postal scales . The base microprocessor 53 then sends back:

a message DCA to validate in zone 73 of the meter RAM, the mark authorizing the initiation of printing, a message DC3 to light the LED associated with the postal scales key, a message DC4 to transmit to the meter a keyboard mask charged with inhibiting certain keys, except for the postal scales key.

In this way, and as long as the postal scales key has not been pressed a second time to return to keyboard mode, the base microprocessor 53 takes control of the meter print register, by messages DC6, and of the display 21, by messages DC1 and DC2. And the base microprocessor 53 also sends messages DC0 to ensure that the printer is automatically set to the postage indications received by the peripheral consisting of the postal scales and its postage calculator.

Obviously, the present invention is in no way limited to the embodiments selected and represented, but, far to the contrary, also includes all variants within the scope of the person skilled in the art.

TABLE I

DIODE MASK
In this example, to manage six diodes associated with six keys, the mask is organized as follows.

| keyboard key | bit | byte 1 | | byte 2 | |
|---|---|---|---|---|---|
| DATE | 0 | $z_{10}$ | | $z_{20}$ | |
| POSTAL SCALES | 1 | $z_{11}$ | | $z_{21}$ | |
| IMPRINT | 2 | $z_{12}$ | | $z_{22}$ | |
| PRINTER | 3 | $z_{13}$ | $\underline{Z}_1$ | $z_{23}$ | $\underline{Z}_2$ |
| HIGH VALUE | 4 | $z_{14}$ | | $z_{24}$ | |
| LABELS | 5 | $z_{15}$ | | $z_{25}$ | |
| * | 6 | $z_{16}$ | | $z_{26}$ | |
| * | 7 | $z_{17}$ | | $z_{27}$ | |

*Since the diodes do not exist in this example, bits 7 and 8 of the bytes are not significant here. They can be used if two new diodes are installed.
$z_{1i}$ = bit of byte $\underline{Z}_1$
$z_{2i}$ = bit of byte $\underline{Z}_2$ TABLE I-continued

| DIODE MASK<br>In this example, to manage six diodes associated with six keys, the mask is organized as follows. | | | |
|---|---|---|---|
| keyboard key | bit | byte 1 | byte 2 |

If $z_{1i} = Z_{2i} = 0$, diode off.
If $z_{1i} = Z_{2i} = 1$, diode lit.
If $z_{1i} <> z_{2i}$, diode flashing.

TABLE II

KEYBOARD MASK AND BUFFER
In the preferred embodiment, to manage a keyboard with ten undifferentiated numeric keys and twelve function keys, the keyboard buffer (2 bytes $\underline{X}_1$, $\underline{X}_2$) and the validation mask (two bytes $\underline{Y}_1$, $\underline{Y}_2$) are organized as follows.

| KEY | BIT | HEAD to BASE KEYBOARD BUFFER | | BASE to HEAD VALIDATION MASK | |
|---|---|---|---|---|---|
| DATE | 0 | $x_{10}$ | $\underline{X}_1$ | $y_{10}$ | $\underline{Y}_1$ |
| POSTAL SCALES | 1 | $x_{11}$ | | $y_{11}$ | |
| IMPRINT | 2 | $x_{12}$ | | $y_{12}$ | |
| PRINTER | 3 | $x_{13}$ | | $y_{13}$ | |
| * | 4 | $x_{14}$ | | $y_{14}$ | |
| LABELS | 5 | $x_{15}$ | | $y_{15}$ | |
| SUB-TOTAL | 6 | $x_{16}$ | | $y_{16}$ | |
| ITEMS COUNTER | 7 | $x_{17}$ | | $y_{17}$ | |
| SERVICE | 0 | $x_{20}$ | $\underline{X}_2$ | $y_{20}$ | $\underline{Y}_2$ |
| POINT | 1 | $x_{21}$ | | $y_{21}$ | |
| CLEAR | 2 | $x_{22}$ | | $y_{22}$ | |
| VALIDATION | 3 | $x_{23}$ | | $y_{23}$ | |
| NUMERIC KEYS (any) | 4 | $x_{24}$ | | $y_{24}$ | |
| HIGH VALUE | 5 | $x_{25}$ | | $y_{25}$ | |
| * | 6 | $x_{26}$ | | $y_{26}$ | |
| * | 7 | $x_{27}$ | | $y_{27}$ | |

*Since the keys do not exist in this example, bits No. 3 of the first byte $\underline{X}_1$ or $\underline{Y}_1$ and Nos. 6 and 7 of the second byte $\underline{X}_2$ or $\underline{Y}_2$ are not significant here. They can be used if three new keys are installed.
$x_{1i}$ = bit of byte $\underline{X}_1$
$x_{2i}$ = bit of byte $\underline{X}_2$
$x_{1i}$ or $x_{2i} = 1$, key pressed
$x_{1i}$ or $x_{2i} = 0$, key not pressed
$y_{1i}$ = bit of byte $\underline{Y}_1$
$y_{2i}$ = bit of byte $\underline{Y}_2$
$y_{1i}$ or $y_{2i} = 1$, key permitted
$y_{1i}$ or $y_{2i} = 0$, key inhibited

I claim:

1. A franking machine which comprises in particular a first portion called the meter and a second portion called the base, a keyboard and a display associated with the first portion, and communication means connecting these two portions, the meter comprising a first microprocessor arranged to manage a printing means and a memory of which certain registers are assigned to the management of postage data, so that the postage data can only be modified to record postage actually printed by the printing means, and so that the printing means cannot print any postage unless these postages are accounted for by modifying the postage data in at least some of said registers, the first microprocessor also managing the keyboard and the display as well as the portion of said communication means intended to transmit messages to the base and to receive messages from the base, the base comprising a second microprocessor arranged so that it manages communication means intended to transmit and to receive messages to or from the meter, wherein the first and second microprocessors carry into practice, in a normal operating mode, a communications protocol adapted to have transmitted to the base representative messages of at least some of the commands acquired on the keyboard and to have retransmitted from the base to the meter the commands executable by the meter, in such a way that, from the meter keyboard, at least certain functions cannot be commanded unless the commands relative to said functions pass through the base.

2. The franking machine of claim 1, wherein the meter also comprises in its program memory instructions enabling it to detect codes relative to keys or combination of keys received from the keyboard corresponding to orders executable by the microprocessor of the meter, the program providing that in the case of recognition of a combination relative to an order executable by said first microprocessor, this order is executed.

3. The franking machine of claim 1, wherein some of the messages concerning the keyboard are messages which are intended to inhibit or activate certain keys.

4. The franking machine of claim 1, wherein some messages concerning the memory associated with the microprocessor of the meter are messages commanding the reading of a zone of said memory, specified in these messages, and commanding the sending of a message in return containing these read data.

5. The franking machine of claim 1, wherein some messages concerning the memory associated with the microprocessor of the meter are messages commanding the writing of specified data at the specified addresses of said memory, the addresses comprising sensitive data that cannot be specified because of instructions from the program of the microprocessor of the base.

6. The franking machine of claim 1, wherein the program of the microprocessor of the meter is provided with instructions interdicting the execution of write messages at the addresses containing sensitive data.

7. The franking machine of claim 1 wherein the microprocessor of the meter stores, in a zone of its memory associated with said keyboard buffer, and updates, a binary word identifying all the non-numeric keys which have been pressed since the last erase order of this binary word.

8. The franking machine of claim 7, in which said binary word also identifies the pressing on at least one numeric key.

9. The franking machine of claim 7, wherein the program of the microprocessor of the meter comprises instructions ensuring that any pressing of certain non-numeric keys of the keyboard of the meter causes the sending of a message by the communication means, this message transmitting said binary word to the base.

10. The franking machine of claim 7, wherein the program of the microprocessor of the base comprises instructions enabling it to identify the non-numeric key or keys that may be contained in the messages received, such identification then causing the sending of a message to erase said binary word in the memory associated with the microprocessor of the meter.

11. The franking machine of claim 7 wherein the program of the microprocessor of the base comprises instructions enabling it to identify, among the non-numeric keys defined by the binary word received, the one that has been pressed last and has caused the sending of the message.

12. The franking machine of claim 11, wherein the program of the microprocessor of the base comprises instructions assigning a precise significance to said non-numeric key pressed last.

13. A franking machine which comprises in particular a first portion called the meter and a second portion called the base, a keyboard and a display associated with the first portion, and communication means connecting these two portions, the meter comprising a first microprocessor arranged to manage a printing means and a memory of which certain registers are assigned to the management of postage data, so that the postage data can only be modified to record postages actually printed by the printing means, and so that the printing means can only print the postage if the postages are accounted for by modifying the postage data in at least some of said registers, this microprocessor also managing a keyboard, the display associated with said meter, and the portion of said communication means associated with the meter and intended to transmit, respectively receive messages to, respectively from, the base, said base comprising a second microprocessor arranged in such a way that it manages the portion of said communication means associated with the base and intended to transmit, respectively receive, messages to, respectively from, the meter, wherein, on the one hand, said first microprocessor is arranged so that, in a normal operating mode, it identifies the key or keys pressed, and has one or more messages representative of the identification transmitted to the base by said communication means, while, on the other hand, said second microprocessor is arranged to interpret the messages received, and to have one or more messages representative of orders transmitted through said communication means, executable by the first microprocessor, in such a way that it is not possible, from the keyboard of the meter, in said normal operating mode, to command any function at least related to the postage, unless the command of these functions passes through the base.

14. The franking machine of claim 13, wherein some of the messages concerning the keyboard are messages which are intended to inhibit or activate certain keys.

15. The franking machine of claim 13, wherein some messages concerning the memory associated with the microprocessor of the meter are messages commanding the reading of a zone of said memory, specified in these messages, and commanding the sending of a message in return containing these read data.

16. The franking machine of claim 13, wherein some messages concerning the memory associated with the microprocessor of the meter are messages commanding the writing of specified data at the specified addresses of said memory, the addresses comprising sensitive data that cannot be specified because of instructions from the program of the microprocessor of the base.

17. The franking machine of claim 13, wherein the program of the microprocessor of the meter is provided with instructions interdicting the execution of write messages at the addresses containing sensitive data.

18. The franking machine of claim 13 wherein the microprocessor of the meter stores, in a zone of its memory associated with said keyboard buffer, and updates, a binary word identifying all the non-numeric keys which have been pressed since the last erase order of this binary word.

19. The franking machine of claim 18, in which said binary word also identifies the pressing on at least one numeric key.

20. The franking machine of claim 18, wherein the program of the microprocessor of the meter comprises instructions ensuring that any pressing of certain non-numeric keys of the keyboard of the meter causes the sending of a message by the communication means, this message transmitting said binary word to the base.

21. The franking machine of claim 18, wherein the program of the microprocessor of the base comprises instructions enabling it to identify the non-numeric key or keys that may be contained in the messages received, such identification then causing the sending of a message to erase said binary word in the memory associated with the microprocessor of the meter.

22. The franking machine of claim 18, wherein the program of the microprocessor of the base comprises instructions enabling it to identify, among the non-numeric keys defined by the binary word received, the one that has been pressed last and has caused the sending of the message.

23. The franking machine of claim 22, wherein the program of the microprocessor of the base comprises instructions assigning a precise significance to said non-numeric key pressed last.

* * * * *

UNITED STATES PATENT AND TRADEMARK OFFICE

CERTIFICATE OF CORRECTION

PATENT NO. : 5,586,035

DATED : 17 December 1996

INVENTOR(S) : Claude MARTIN

It is certified that error appears in the above-indentified patent and that said Letters Patent is hereby corrected as shown below:

| Column | Line | |
|---|---|---|
| 3 | 61 | delete "to" before "assigned" insert --to--after "assigned" |
| 6 | 8 | Change "FX" to --$F_x$--. |
| 7 | 36 | Change "DC" to --DC5--. |
| 7 | 39 | Change "E bytes" to --X bytes--; after "address" insert -- Y --. |
| 7 | 42 | Change "FS" to --F5--. |
| 8 | 20 | Change "byte X" to --byte Y--. |
| 8 | 26 | Change "DC0" to --DCC--. |

Signed and Sealed this

Twenty-ninth Day of July, 1997

Bruce Lehman

*Attest:*

BRUCE LEHMAN

*Attesting Officer*

*Commissioner of Patents and Trademarks*